US006140899A

United States Patent [19]

Kayser et al.

[11] Patent Number: 6,140,899

[45] Date of Patent: Oct. 31, 2000

[54] MAGNETIC COUPLER AND ASSOCIATED METHOD FOR COUPLING CONDUCTORS

[75] Inventors: Kenneth W. Kayser, Roanoke, Va.; W. Richard Frederick, Mundelein, Ill.

[73] Assignee: Display Edge Technology Ltd., Troy, Ohio

[21] Appl. No.: 09/167,706

[22] Filed: Oct. 6, 1998

Related U.S. Application Data

[60] Provisional application No. 60/061,884, Oct. 10, 1997.

[51] Int. Cl.[7] ..... H01F 7/08

[52] U.S. Cl. ..... 335/220; 335/236

[58] Field of Search ..... 335/220–236, 335/250, 281, 282; 336/130–136

[56] References Cited

U.S. PATENT DOCUMENTS

| | | | |
|---|---|---|---|
| 3,995,209 | 11/1976 | Weston . | |
| 4,264,827 | 4/1981 | Herzog . | |
| 5,040,085 | 8/1991 | Elsausser et al. | 360/98.07 |
| 5,091,710 | 2/1992 | Ohba et al. | 335/229 |
| 5,229,652 | 7/1993 | Hough . | |
| 5,736,967 | 4/1998 | Kayser et al. . | |

FOREIGN PATENT DOCUMENTS

| | | |
|---|---|---|
| 0417542A1 | 3/1991 | European Pat. Off. . |
| 417542 | 3/1991 | European Pat. Off. . |

OTHER PUBLICATIONS

International Search Report dated Jan. 25, 1999, PCT/US98/21039.

*Primary Examiner*—Lincoln Donovan
*Attorney, Agent, or Firm*—Thompson Hine & Flory LLP

[57] ABSTRACT

A magnetic coupler for magnetically or inductively coupling a pair of conductors. The coupler includes a first magnetic core member having prongs and at least one slot between the prongs for receiving the conductors, and a second magnetic core member. The coupler further includes a base for retaining the first core member and a shuttle for retaining the second core member. The shuttle is slidably mounted within the base such that the shuttle slides across and in contact with the prongs from an open position in which the slot is exposed to a closed position in which the slot is covered by the second core member, and the conductors are thereby contained within the slot. The sliding action of the cores cleans debris off the mating surfaces of the core elements to provide good mating contact between the core members for efficient coupling.

23 Claims, 4 Drawing Sheets

MAGNETIC COUPLER AND ASSOCIATED METHOD FOR COUPLING CONDUCTORS

PRIORITY CLAIM

This application claims the benefit of U.S. provisional application Ser. No. 60/061,884 filed Oct. 10, 1997.

BACKGROUND

The present invention relates to a coupler which is useful in magnetically or inductively coupling a pair of communication loops, power loops, or combined power and modulated data loops.

Electrical communication systems often comprise a number of interrelated but physically separated subsystems. Data may be communicated from the source terminal to the subsystems, and from the subsystems to the source terminal, by means of electrical conductors carrying voltage variations. The terminal and the subsystems may each have a wire loop or conductor emanating therefrom, and the conductors may be efficiently coupled by means of a coupler. The efficiency of the coupler preferably reaches levels of over 90%. Voltage variations transmitted via the conductors may then communicate data between the source terminal and substations. Further, magnetic coupling allows for easy connecting and unconnecting of the source terminal and the subsystems so that various subsystems or branches may be removed and/or replaced without shutting down the entire system. One example of a communication system using magnetic coupling is U.S. Pat. No. 4,264,827.

In order to magnetically couple insulated conductors, the conductors should be placed in close proximity to each other. Surrounding the coupled conductors with magnetic cores increases induction efficiency. One such application of magnetic couplers for use with electronic communication devices or systems is disclosed in commonly-owned U.S. Pat. app. Ser. No. 08/398,297 filed Mar. 3, 1995 in the name of Frederick et al., hereby incorporated by reference. That application discloses an article information display system using electronically controlled tags. More particularly, an apparatus for displaying the price and name of a product on electronic display tags adjacent to the respective products is disclosed. The system displays information for individual articles, and the displays can be updated from a central location. The application discloses the use of a "clam-shell" coupler to couple a branch distribution loop to a main distribution loop. In this manner, information concerning the article for sale may be communicated from the main terminal to the substations.

Couplers are typically movable from an open position, wherein the core elements are separate and exposed to the environment, to a closed position where the core elements are pressed together and the conductors are contained therein. It is known that debris trapped between the magnetic core elements may lower the efficiency of the coupler. Dirt, dust, or residue from the manufacturing process collected on core elements lowers the effectiveness of the coupler. Accordingly, there exists a need for a coupler which can clean debris off of the exposed core elements to thereby provide intimate contact between the cores. There also exists a need for a coupler which can be quickly and easily operated by a worker on-site to allow convenient connection of conductors.

SUMMARY OF THE INVENTION

In one aspect of the present invention a magnetic coupler is provided in which sliding contact between two magnetic core members cleans debris off the mating surfaces of the core elements and ensures intimate contact between the core elements, thereby providing increased coupling efficiency.

In another aspect of the present invention a method for coupling a pair of conductors utilizing at least two magnetic core members is provided. The method involves providing a first magnetic core member having at least one prong with a mating end surface and providing a second magnetic core member. The conductors are placed adjacent the first magnetic core member. At least one of the magnetic core members is moved to produce sliding contact between a portion of the second magnetic core member and the mating end surface of the first magnetic core member thereby cleaning debris off the mating end surface to provide intimate contact between the core members upon completion of the sliding contact.

More particularly, in one embodiment the present invention includes an "E" core member and an "I" core member. The "E" core has three prongs with a pair of slots therebetween. The coupler further includes a shuttle to retain the "I" core, and a base to retain the "E" core member. The base includes a set of extensions each of which carries a flange at its end, and the extension together which form a guide in which the shuttle and the "I" core slide. In this manner the "I" core can slide from an open position in which the slots are exposed to a closed position in which the slots are covered by the "I" core member, and the conductors are retained within the coupler. When in the closed position, the shuttle forms an interference fit with the base to thereby retain the shuttle in place. The sliding action of the "I" core across the "E" core removes any build-up of debris on the exposed core elements, thereby providing clean intimate contact between the magnetic core elements. Furthermore, the coupler is easy to open and close. The coupler can be conveniently located in the desired position, and once so located, can be easily moved to the closed position with a single hand. To open the coupler, a screwdriver or other similar tool can be inserted into a slot in the coupler and used to slide the shuttle from the base.

It is recognized that other embodiments of magnetic couplers or magnetic coupling systems which incorporate the sliding contact between core members of the present invention are possible without departing from the intended scope of the present invention.

These and other objects and advantages of the present invention will be more fully understood and appreciated by reference to the following description, the accompanying drawings and the appended claims.

DETAILED DESCRIPTION

Figure 1:
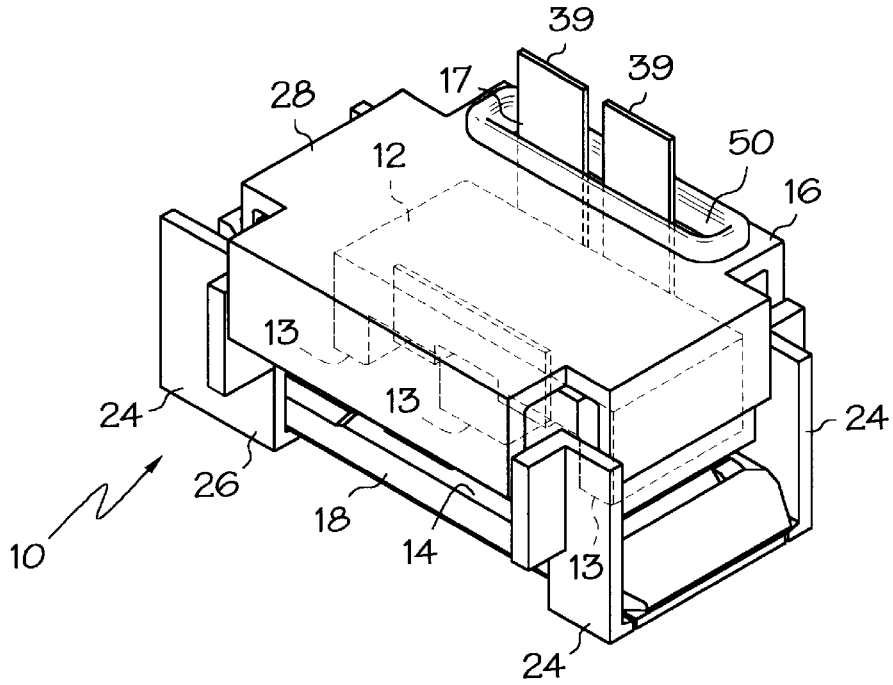
FIG. 1 is a perspective view of the coupler of the present invention, shown in the closed position, and a conductor.
Figure 2:
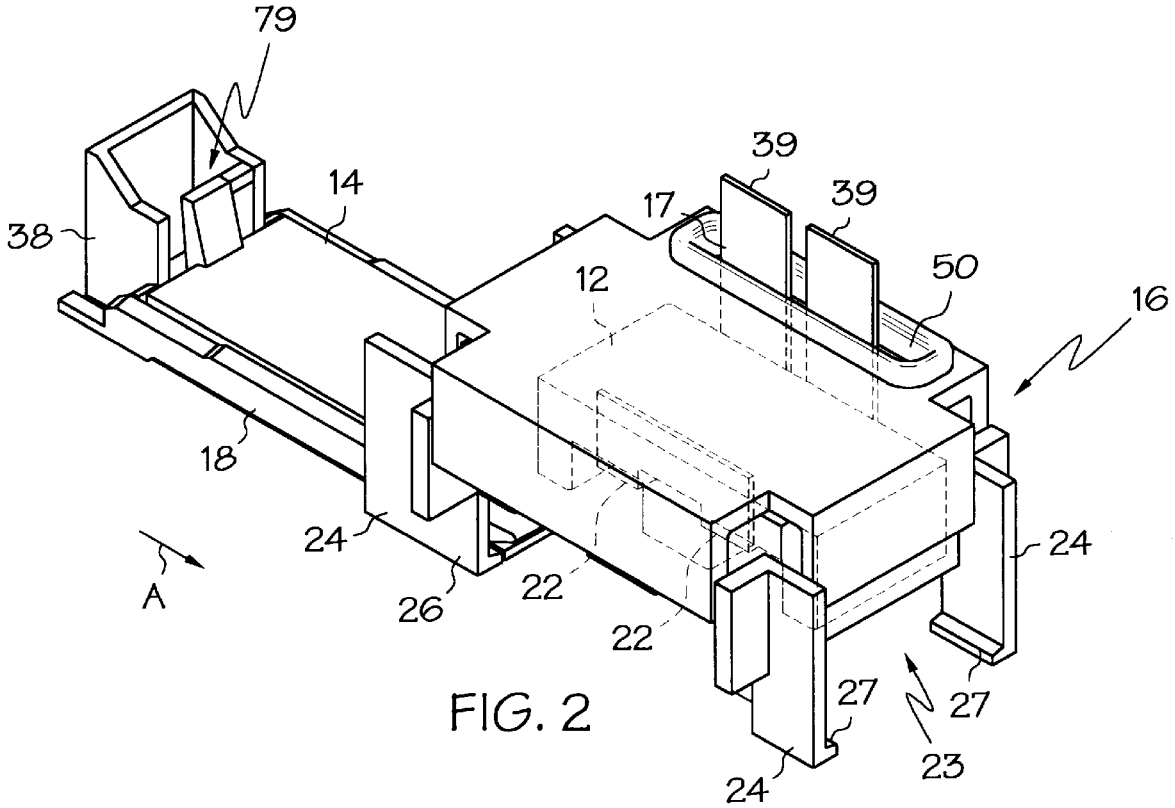
FIG. 2 is a perspective view of the coupler and conductor of FIG. 1 shown in the open position.
Figure 3:
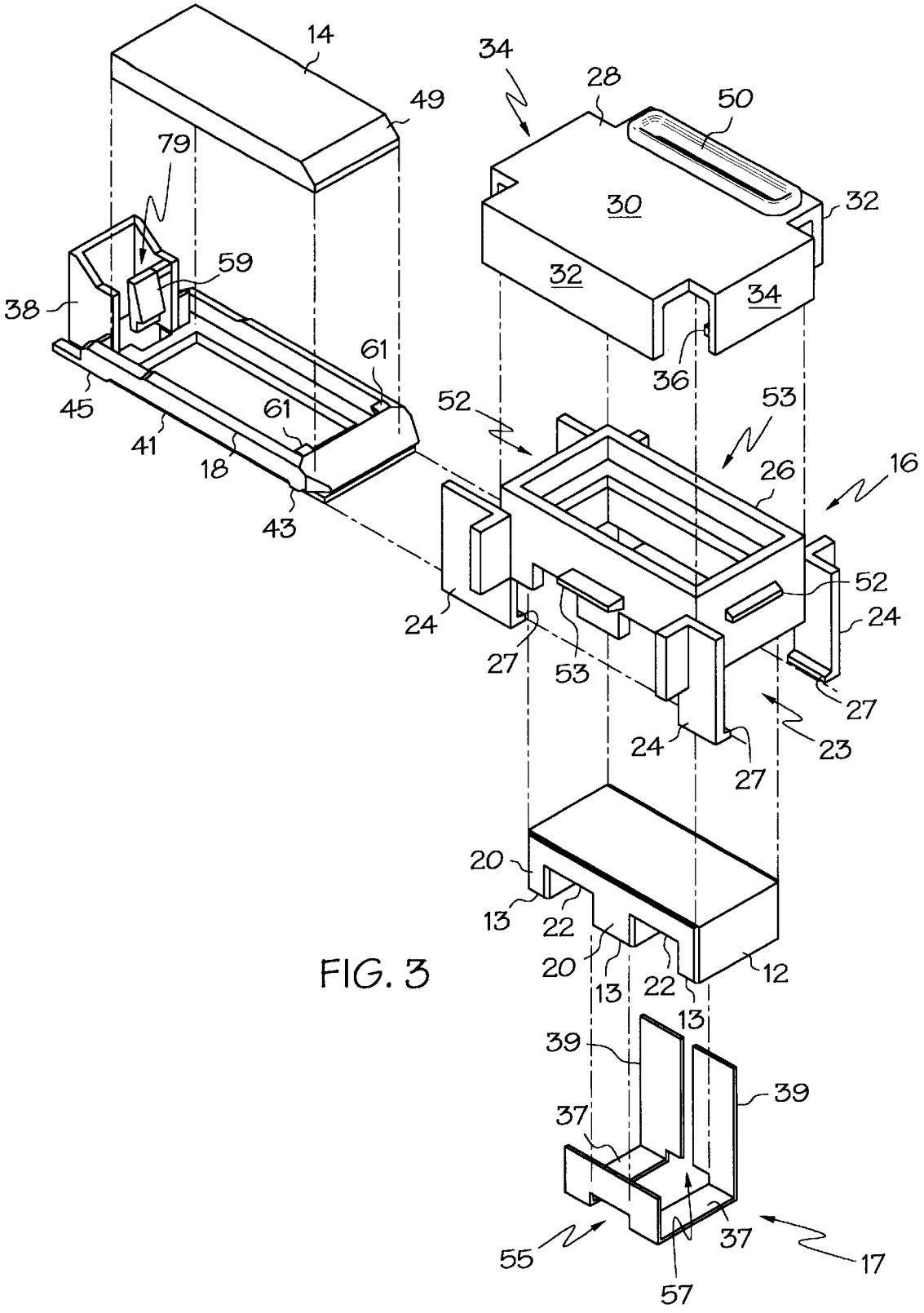
FIG. 3 is an exploded, perspective view of the coupler and conductor of FIG. 1.

As shown in FIGS. 1–3, a magnetic coupler 10 according to one embodiment of the present invention comprises a "E"

core member 12, an "I" core member 14, a base 16 for retaining the "E" core member 12, and a shuttle 18 for retaining the "I" core member 14. The base 16 includes a lattice 26 and a cover 28. In a preferred embodiment, a copper conductor 17 is fitted within the slots of the "E" core 12. The conductor 17 retains the "E" core 12 within the base 16. The shuttle 18 receives the "I" core 14, and is slidingly connected to the base 16. The shuttle 18 may slide from an open position to a closed position, and its reciprocation is guided by the flanges 27 of the base 16.

The "E" core member 12 and "I" core member 14 are formed of magnetic material to increase the induction efficiency between the electrical conductors. As used herein the term "magnetic core member" refers to a core member formed from a magnetic material, such magnetic material being a material having a relatively high permeability, such as materials which are commonly used as transformer cores or inductive sensor cores. The "E" core member 12 is preferably "E" shaped in profile, having three prongs 20. Each prong 20 has a mating surface 13 which faces the shuttle 18, as shown in FIG. 1. The prongs 20 also define a pair of slots 22 (FIG. 3). Copper conductor 17 has a pair of parallel arms 37 which fit within the slots 22 of the "E" core. Each arm 37 terminates in a flange 39 which passes through the slot 50 of the cover 28. Conductor 17 further has a pair of generally rectangular cut-outs 55 and 57. Although the conductor 17 is described herein as copper, those skilled in the art will appreciate that the conductor 17 may be made of any electrically conductive material.

"I" core member 14 is generally rectangular in profile. However, the coupler of the present invention may use other shaped core members in place of the "I" core 14 or the "E" core 12. For example, a second "E" core member may be used in place of the "I" core 14 without departing from the scope of the present invention. Further, the "E" core 12 could be replaced with a "U" core and/or the "I" core could be replaced with a "U" core, any of such variations, as well as others, being apparent to one skilled in the art.

As shown best in FIG. 3, the base 16 is comprised of a lattice 26 and a cover 28. The lattice 26 receives the "E" core member 12, and includes four parallel extensions 24. Lattice 26 further includes a pair of tabs 52 extending along its ends, and a second pair of tabs 53 extending along its sides. The "E" core is received by the lattice 26, and copper conductor 17 is then placed around the lattice 26. Cut-outs 55 and 57 fit around the tabs 53, thereby retaining the conductor 17 and the "E" core 12 within in the lattice 26. Base 16 further has a set of four extensions 24 extending generally perpendicular to the base 16 from each corner. Each extension 24 terminates in an inwardly-extending flange 27, and the flanges 27 together comprise a guide 23.

Cover 28 includes a generally rectangular plate 30, a pair generally rectangular side panels 32, and a pair of generally rectangular end panels 34. The panels 32, 34 are oriented generally perpendicular to the plate 30. Each end panel 34 has a finger 36 which is shaped to latch over a respective tab 52 of the lattice 26. In this manner, the cover 28 receives and retains the lattice 26 between the panels 32, 34. Cover 28 further includes a longitudinal cut-out 50 through which the flanges 39 of the conductor 17 may pass.

Shuttle 18 is generally rectangular in top view and is shaped to receive the "I" core member 14. Shuttle 18 has a flexible clip 59 with an angled surface to retain the "I" core within the shuttle. Shuttle 18 also includes a leg 38, as well as a front ramp 43 and a rear ramp 45 located along its top edge 41 or upper surface. The front ramp 43 and rear ramp 45 are raised surfaces that extend forwardly of the top edge 41 or upper surface. The front ramp 43 is adjacent the front edge of the shuttle, and the rear ramp 45 is adjacent the rear edge of the shuttle.

As shown in FIG. 1 and FIG. 2, when fully assembled the magnetic coupler 10 of the present invention comprises the shuttle 18 slidably mounted to the base 16. The shuttle 18 is received within the flanges 27 of the extensions 24. Thus, as the shuttle translates with the respect to the base 16, the inwardly-extending flanges 27 together comprise a guide 23 to direct the translation of the shuttle 18. Lower support flanges 65 (FIG. 4) helps to retain the shuttle 18 within the base, and guides the translation of the shuttle 18.

FIG. 2 shows the magnetic coupler 10 in its open position. The sliding path of the shuttle 18 from the open position to the closed position is indicated by the arrow A in FIG. 2. When in the open position, the slots 22 are not covered by the "I" core member, and when the coupler is in the closed position the slots are covered by the "I" core. Leg 38 of the shuttle 18 limits the translation of the shuttle 18 to the right as shown in FIG. 1. Leg 38 extends generally perpendicularly to the path of the shuttle. The extensions 24 also extend in a direction generally perpendicular to the shuttle path.

Figure 5:
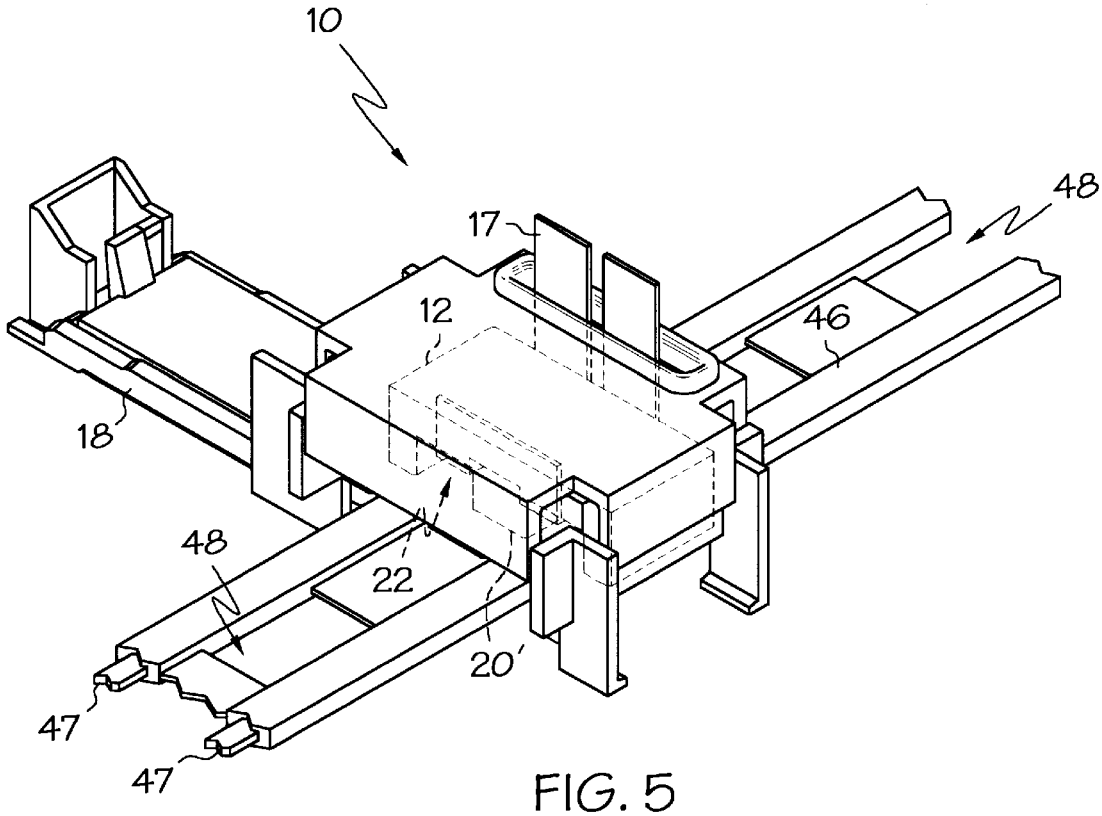
FIG. 5 is the perspective view of the coupler and conductor of FIG. 2, shown with a rail member.

As shown in FIG. 5, the present invention preferably is used with a rail member 46 having an electrical conductor 47 contained therein. The rail member 46 has a plurality of slots 48 to receive central prong 20' of the "E" core 12. In this manner the conductor 47 and the conductor 17 may be magnetically coupled by the coupler 10. Once the "E" core is located in the desired position, the shuttle 18 may be moved to the closed position. For example, a worker using the coupler of the present invention may locate the coupler, by feel, such that the central prong 20 fits within an associated slot 48. While retaining the coupler in this position, the worker may then easily slide the shuttle 18 to the closed position using only a single hand. Thus, the present invention provides for a coupler that can be easily located and operated with only a single hand.

When shuttle 18 is shifted to the closed position, the front ramp 43 and rear ramp 45 contact the respective flanges 27 as the shuttle nears the closed position. Due to the increased width of the ramps, the shuttle 18 is frictionally engaged by the lattice 26. Also, the "E" core 12 and "I" core 14 are pressed into intimate contact due to the interference fit between the ramps 43, 45 and the flanges 27. In this manner, an improved connection between the E core and I core is maintained. Although configured for normally retaining the shuttle 18 within the base 18 when in the closed position, the inward extension of flanges 27 is preferably limited to allow the shuttle 18 to be pulled away from the base 16 if substantial separating force is present. In particular, extensions 24 are sufficiently flexible to be moved outward by the separating force to allow the shuttle 18 to pass by the flanges 27. The feature helps reduce potential damage in applications where such separating forces may be experienced when a person fails to move the shuttle 18 to the open position before making adjustments.

Figure 4:
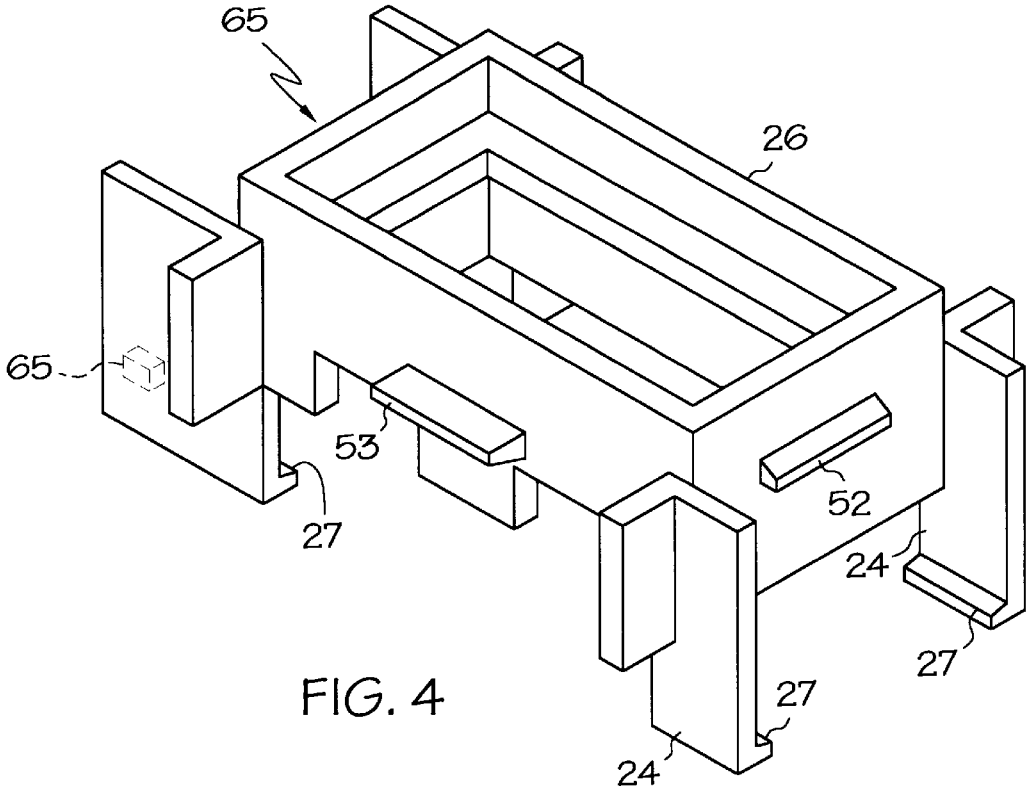
FIG. 4 is a perspective view of the lattice of the coupler of FIG. 1.

In normal operation, the shuttle 18 may be uncoupled from the lattice 26 by inserting a screwdriver or other appropriately shaped tool into the slot 79 of the shuttle 18. By pivoting the screwdriver against the cover 28 the shuttle can be slid to the open position. The coupler 10 may then be removed from the rail member 46, and the conductors thereby uncoupled. Additionally, the front ramp 43 acts so as to retain the shuttle 18 within the base 16 when the shuttle 18 is in the open position. When in the open position, the front ramp 43 is wedged between flanges 27 and a lower support flanges 65 (FIG. 4). The front ramps 43, flanges 27 and lower support flanges 65 cooperate so as to keep the shuttle from falling out of the base 16.

Additionally, when the coupler 10 is moved from an open position as shown in FIG. 2 to the closed position as shown in FIG. 1, the movement of the "I" core member 14 across the prongs 20 of the "E" core member 12 effectively removes debris from the mating surfaces 13. Beveled surface 49 of the "I" core 14 acts so as to prevent the shuttle 18 from becoming jammed as it traverses the "E" core. Cleaning the cores makes coupling highly efficient and gives the resultant connection good balance and uniformity.

Figure 6:
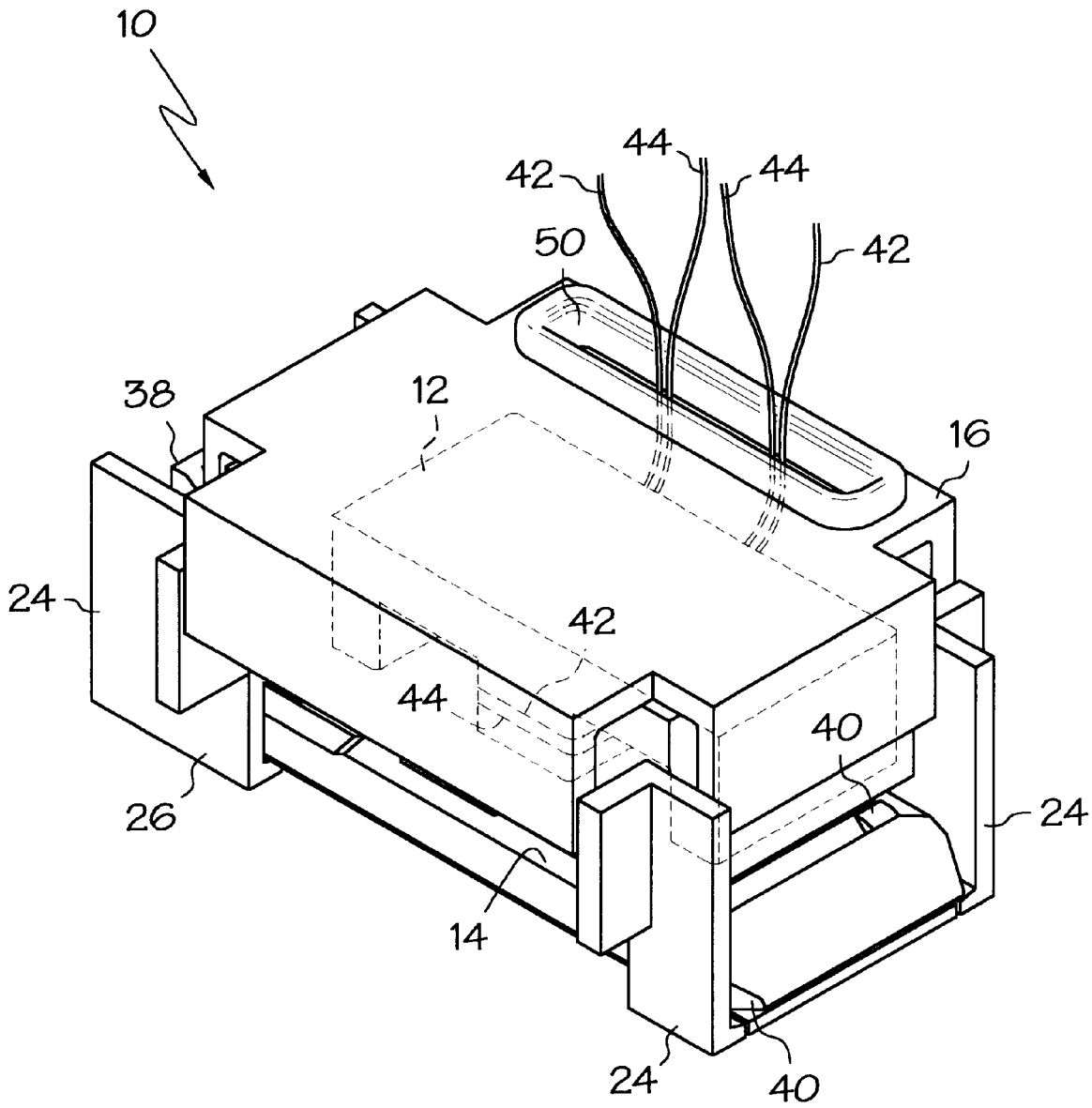
FIG. 6 is a perspective view of the magnetic coupler of FIG. 1, shown with a pair of wire loops.

While the invention should be useful in any application in which it is desired to magnetically couple a pair of conductors, it may be particularly useful in coupling loops to provide one or two-way communication between one or more terminals. Furthermore, although the invention is illustrated using a copper conductor and a rail member, it is to be understood that the coupler of the present invention may be used to couple a pair of loose wires, as is illustrated in FIG. 6. Alternately, the coupler 10 may be useful in coupling a loose wire to the copper conductor 17, or in coupling a loose wire to the rail member 46. The magnetic coupler 10 of the present invention may be used to couple, for example, branch distribution loops to main distribution loops. However, those skilled in the art will appreciate that the coupler 10 may be used at any point where conductor coupling is desired.

While the forms of the apparatus herein described constitute a preferred embodiment of the invention, it is to be understood that the present invention is not limited to these precise forms and that changes may be made therein without departing from the scope of the invention. In particular, the base and shuttle of a coupler in accordance with the present invention could take on a variety of configurations which provide sliding contact between the core members. The base and/or shuttle could also be formed integral with other structures of a larger system. Still further, it is recognized that sliding contact between core members need not take place along the entire path of movement from the open to closed position of the coupler. For example, constructions in which the moving core member is pressed into sliding contact with the non-moving core member just prior to reaching the closed position are envisioned and are likewise considered within the scope of the present invention.

What is claimed is:

1. A coupler for magnetically or inductively coupling a first and a second electrical conductor, the coupler comprising:

a magnetic E core member having prongs, each prong having a mating end surface, said E core member further having slots between said prongs for receiving said conductors;

a second magnetic core member;

a base for retaining said E core member; and a shuttle for retaining said second core member, said shuttle being slidably mounted to said base such that said second core member slides in a path across and in contact with said mating end surfaces from an open position in which said slots are uncovered to a closed position in which said slots are covered by said second core member and said conductors are thereby contained within said slots, wherein said sliding contact with said second core member cleans debris off said mating end surfaces to provide intimate contact between said core members.

2. The coupler of claim 1 wherein said second core member is an I-core member.

3. The coupler of claim 2 wherein said base further includes a plurality of extensions on either side of said path, each extension including an inwardly extending flange which receives said shuttle and retains said I core in contact with said mating end surfaces of said prongs.

4. The coupler of claim 3 wherein said shuttle has an upper surface and said shuttle further comprises a plurality of ramps extending from said upper surface such that when said shuttle nears said closed position said ramps are received by said flanges to form an interference fit therewith.

5. The coupler of claim 4 wherein said first conductor is mounted within said base, said first conductor including a pair of arms which fit within said slots and a pair of upwardly-extending flanges.

6. The coupler of claim 5 wherein said plurality of ramps comprises a first pair of opposed ramps located adjacent a front edge of said shuttle and a second pair of opposed ramps located adjacent a rear edge of said shuttle.

7. The coupler of claim 6 wherein said base further comprises a cover and a lattice, said cover including a generally rectangular plate and four generally rectangular panels, each panel extending from a respective edge of said plate and oriented generally perpendicular to said plate, said cover being shaped to receive and retain said lattice between said rectangular panels.

8. The coupler of claim 7 wherein said shuttle further includes a leg extending generally perpendicular to said path to limit the translation of said shuttle in a first direction.

9. The coupler of claim 8 wherein said cover includes a longitudinal cut-out in said plate to allow said flanges to pass therethrough.

10. The coupler of claim 9 wherein said I-core has a tapered surface on a forward end thereof, said tapered surface being shaped to prevent said shuttle from becoming jammed as said shuttle is slid to said closed position.

11. The coupler of claim 10 wherein said base further includes a pair of side tabs protruding therefrom, and wherein said first conductor further includes a pair of notches shaped and located so as to fit about said side tabs to thereby retain said first conductor and said E-core member in said base.

12. A method for coupling a first and a second electrical conductor comprising the steps of:

providing a coupler comprising a magnetic E core member having prongs, each prong having a mating end surface, said core member further having slots between said prongs for receiving said conductors, said coupler further comprising a second magnetic core member, a base for retaining said E core member, and a shuttle for retaining said second core member, said shuttle being slidably mounted to said base such that said second core member slides in a path across and in contact with said mating end surfaces from an open position in which said slots are uncovered to a closed position in which said slots are covered by said second core member;

placing said first and second conductors in said slots; and sliding said shuttle to a closed position in which said slots are covered by said second core member and said conductors are thereby contained within said coupler, said sliding motion cleaning debris off said mating end surfaces to provide intimate contact between said core members.

13. The method of claim 12 wherein said second core member is an I-core member having one surface which slidingly contacts said mating end surfaces of said E core during said sliding step.

14. The method of claim 13 wherein said base further includes a plurality of extensions on either side of said path, each extension including an inwardly extending flange which receives and guides said shuttle during said sliding step.

15. The method of claim 14 wherein said shuttle has an upper surface and said shuttle further comprises a plurality of ramps extending from said upper surface such that when said shuttle nears said closed position said ramps are received by said flanges to form an interference fit therewith.

16. The method of claim 15 further comprising the step of mounting said first conductor within said base such that a pair of arms of said first conductor fit within said slots and a pair of upwardly-extending flanges extend through a longitudual cut-out of said base.

17. A method for coupling a pair of conductors utilizing at least two magnetic core members, said method comprising the steps of:

providing a first magnetic core member having at least one prong with a mating end surface;

providing a second magnetic core member;

placing said conductors adjacent said first magnetic core member; and moving at least one of said magnetic core members to produce sliding contact between a portion of said second magnetic core member and said mating end surface of said first magnetic core member thereby cleaning debris off said mating end surface to provide intimate contact between said core members upon completion of said sliding contact.

18. A method for effecting efficient inductive coupling of conductors utilizing at least two magnetic core members, said method comprising the steps of:

providing a first magnetic core member having at least two prongs extending therefrom, each prong having a mating end surface, at least one slot formed between said prongs;

providing a second magnetic core member;

placing at least a portion of each of said conductors within said slot; and moving at least one of said magnetic core members to produce sliding contact between a portion of said second magnetic core member and said mating end surfaces of said first magnetic core member thereby cleaning debris off said mating end surface to provide intimate contact between said magnetic core members upon completion of said sliding contact.

19. The method of claim 18 wherein upon completion of said moving step said conductors are enclosed within said slot by a portion of said second magnetic core member which extends over said slot.

20. The method of claim 18 wherein said first magnetic core member is an E core member including three prongs and in said moving step said second magnetic core member is moved.

21. A coupler for magnetically or inductively coupling at least a first and a second electrical conductor, the coupler comprising:

a first magnetic core member having at least two prongs extending therefrom, each prong having a mating end surface, said first core member further having at least one slot formed between said prongs for receiving said conductors;

a second magnetic core member;

a base for retaining said first core member; and a shuttle for retaining said second core member, wherein said base and said shuttle are movable relative to one another from an open position in which said slot is uncovered to a closed position in which said slot is covered by said second magnetic core member for retaining said conductors within said slot, wherein said relative movement produces sliding contact between said second magnetic core member and said mating end surfaces of said first magnetic core member for cleaning debris from said mating end surfaces.

22. The coupler of claim 21 wherein said first core member is an E core member having at least three prongs, and wherein said second core member is an I core member.

23. The coupler of claim 21 wherein said base further includes at least two extensions on either side of a path of said sliding contact, each extention including and inwardly facing flange which receives said shuttle and retains said second magnetic core member in contact with said mating end surfaces of said prongs.

* * * * *